US005419598A

United States Patent [19]

Kreitzer

[11] Patent Number: 5,419,598

[45] Date of Patent: May 30, 1995

[54] LOCK FOR TRASH BIN

[76] Inventor: Joseph D. Kreitzer, 520 Pine St., Greenville, Ohio 45331

[21] Appl. No.: 234,163

[22] Filed: Apr. 28, 1994

[51] Int. Cl.[6] ..... E05C 19/12

[52] U.S. Cl. ..... 292/230; 292/205

[58] Field of Search ..... 292/230, 239, 258, 259, 292/231, 131, 205, 237, 246, 232; 220/318, 316

[56] References Cited

U.S. PATENT DOCUMENTS

| | | | |
|---|---|---|---|
| 2,533,396 | 12/1950 | Payne | 292/340 |
| 3,687,317 | 8/1972 | Gagel | 214/304 |
| 4,155,584 | 5/1979 | Pracchia | 294/73 |
| 4,182,530 | 1/1980 | Hodge | 294/73 |
| 4,363,588 | 12/1982 | Stickney | 414/408 |
| 4,431,220 | 2/1984 | Loughlin | 292/340 |
| 5,015,021 | 5/1991 | Wyson et al. | 292/230 |
| 5,029,724 | 7/1991 | Serio | 220/322 |
| 5,042,856 | 8/1991 | Goodman | 292/259 |
| 5,094,358 | 3/1992 | Serio, Sr. | 220/315 |
| 5,149,153 | 9/1992 | Drewry et al. | 292/104 |
| 5,201,434 | 4/1993 | DeVivo et al. | 220/315 |
| 5,213,382 | 5/1993 | Dawdy et al. | 292/228 |
| 5,224,743 | 7/1993 | Dawdy et al. | 292/228 |

*Primary Examiner*—Peter M. Cuomo
*Assistant Examiner*—Monica E. Millner
*Attorney, Agent, or Firm*—Biebel & French

[57] ABSTRACT

An apparatus for securing a lid of a trash bin includes a frame couplable to a wall of the trash bin. The frame defines a housing which at least partially encloses moving parts of the locking mechanism. This housing inhibits tampering with the locking mechanism and protects the locking mechanism against exposure to the trash placed in the bin. In addition, the apparatus includes a coupler for holding the housing against the wall of the trash bin so as to prevent unauthorized access from outside the trash bin while permitting an individual locked inside the trash bin to decouple a portion of the frame from the bin to permit the individual to exit the bin.

18 Claims, 8 Drawing Sheets

20
10
16
38
38'
48
118
34
114
56
50
42
112
54
32
58
78
40
76
108
74
92
46
90
60
140
142
44
62
130
70
64
66
72
158
160
68
30
12

LOCK FOR TRASH BIN

BACKGROUND OF THE INVENTION

1. Field of the Invention

This invention relates to a locking mechanism for a trash bin, and more particularly, it relates to a locking mechanism for preventing unauthorized access from outside the trash bin while permitting an individual locked inside the trash bin to decouple a portion of the frame supporting the locking mechanism from the bin to permit the individual to exit the bin. The invention also relates to a locking mechanism enclosed in a housing for protection against trash, the elements and tampering.

2. Description of the Related Art

Private trash bins having hinged lids are a common fixture on many commercial properties. The costs associated with a trash bin may be increased by unauthorized usage, since unauthorized usage increases the frequency with which the trash bin must be dumped. Furthermore, unauthorized usage of a trash bin dedicated to one form of recyclable material may result in contamination of the recyclable material. Apart from these concerns, the use of a locking mechanism to secure the trash bin saves the trash collector time when the trash bin must be dumped.

Nonetheless, the trash bin must be accessible by a trash collector when the time does come to dump it. In particular, the locking mechanism should automatically release when the trash bin is dumped so that the operator is not required to leave his truck prior to dumping the bin.

Since the trash which is placed in a trash bin may corrode or jam the locking mechanism, it is preferable that the locking mechanism not be exposed directly to the trash. One possible solution to this problem is to place the locking mechanism on the exterior of the trash bin. Unfortunately, this exposes the locking mechanism to tampering and to corrosion by the elements.

In addition, a locking mechanism placed on the exterior of the trash bin is inaccessible to an individual locked inside the bin. An individual locked inside such a bin may be harmed due to extended confinement and exposure to the trash, and may suffer additional harm if the trash bin is dumped while the individual is still inside. Since trash bins are typically rigid constructions of metal, it would be difficult for an individual locked inside such a bin to obtain help from outside.

SUMMARY OF THE INVENTION

There is, therefore, a present need to provide an apparatus for securing a lid of a trash bin which is protected from exposure to the trash while permitting an individual locked inside the trash bin to decouple a portion of the frame supporting the locking mechanism from the bin to permit the individual to exit the bin. The trash bin and locking mechanism are two separate units so that the lock can be retrofit on existing trash bins.

In one aspect, this invention comprises an apparatus for securing a lid of a trash bin. The apparatus includes a frame couplable to a wall of the trash bin. In addition, the apparatus includes a pawl, at least one locking member, an abutment member and a lever, each supported by the frame.

The locking member includes a lid-restraining portion for restraining the lid of the trash bin from movement out of a closed position when the locking member is in a locked position. The abutment member is operatively associated with the locking member to restrain the locking member from movement from the locked position toward the released position. The pawl is supported such that, when the locking member is in its locked position and the pawl is in a normal position, an abutment surface of the pawl faces the abutment member. This pawl in its normal position restrains the locking member from movement toward its released position, thereby locking the trash bin. In addition, the lever is supported such that movement of the lever from a first position toward a second position pivots the pawl away from its normal position. Pivoting the pawl away from its normal position releases the locking member from restraint against movement toward its released position, thereby unlocking the trash bin.

In one form, the frame defines a housing which at least partially encloses the abutment member, the pawl and the lever. In a preferred embodiment, this housing inhibits tampering with the locking mechanism and protects the locking mechanism against exposure to both the trash placed in the bin and the elements.

In another form, the frame includes a first portion, a second portion and a pivotal coupler coupling the first and second portions to each other such that the locking member is supported for pivotal movement by the first portion and the second portion is adapted to be rigidly mounted to a wall of the trash bin. In addition, the apparatus includes a coupler for holding the first portion in engagement with the wall of the trash bin. According to one embodiment, the coupler includes a handle and screw mechanism threadedly engaged with the first portion.

Therefore, it is one object of the present invention to provide a locking mechanism for a trash bin which may be released from an interior of the trash bin.

It is another object of the invention to provide a locking mechanism for a trash bin having a housing for protecting the locking mechanism against exposure to the trash placed in the bin.

These objects, and others, may be more readily understood in connection with the following specification, claims, and drawings.

DESCRIPTION OF THE PREFERRED EMBODIMENT

Figure 1:
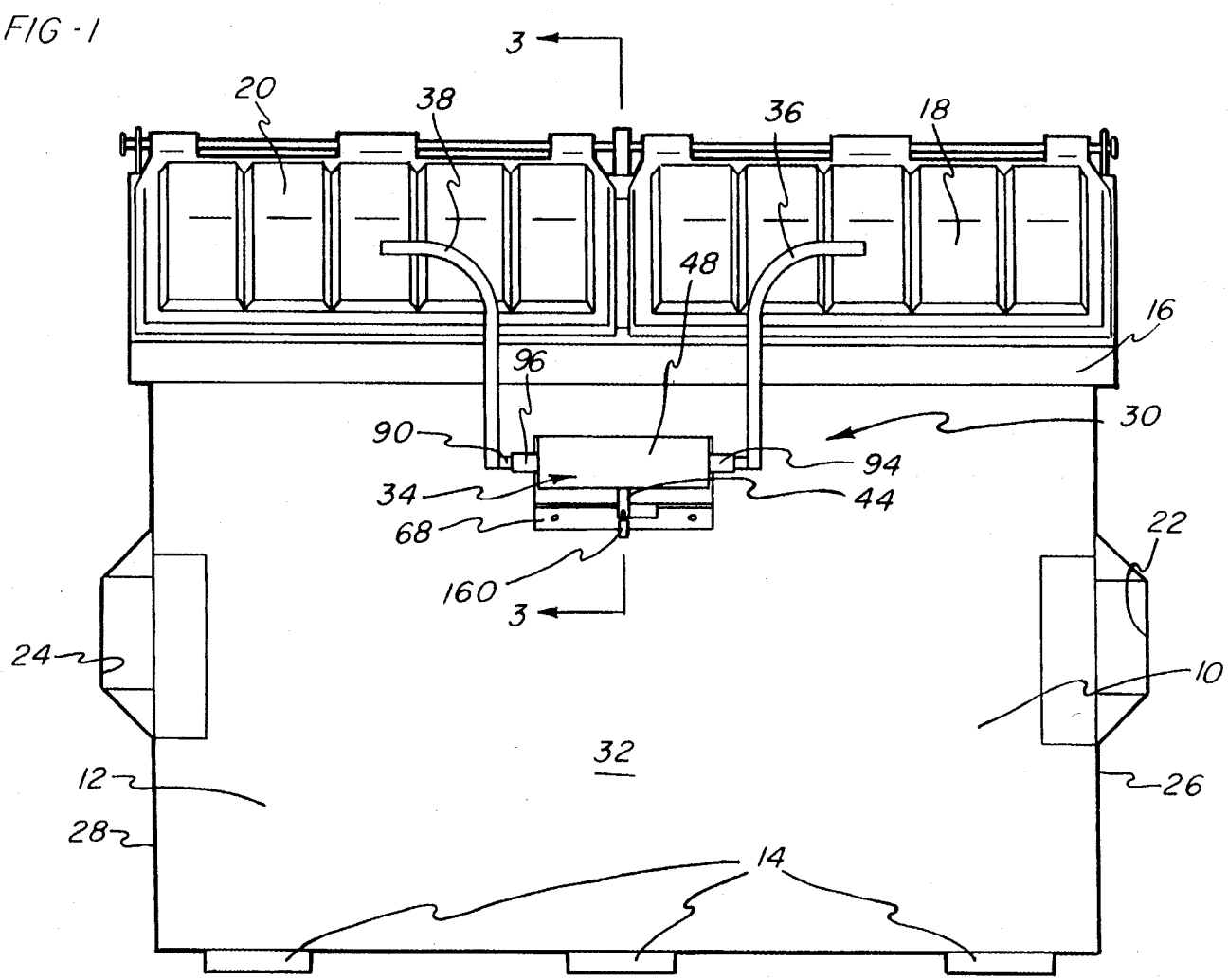
FIG. 1 is a front elevational view of a trash bin mounting a locking apparatus according to the present invention.

FIG. 1 shows a front elevational view of a trash bin, hereafter designated a trash bin 10, on which a preferred embodiment of the invention may be used. The trash bin 10, which is of conventional construction, includes a box-like body 12 accessible through an upper opening (not shown) surrounded by a flange 16. The body 12 is supported by feet 14. A pair of lids 18, 20 are hinged to the body 12 for pivotal movement between an open position in which the interior of the trash bin (not shown) is accessible and a closed position in which the lids 18, 20 are seated on the flange 16 to cover the upper opening.

In the embodiment shown in FIG. 1, the flange 16 is slanted downwardly toward the front of the trash bin so that the lids 18, 20 likewise slant downwardly toward the front of the trash bin when they are in the closed position. The body 12 is preferably constructed of metal and the lids 18, 20 are preferably constructed of plastic, but either may be formed of any suitable material.

A pair of pockets or sockets 22, 24 are mounted on side walls 26, 28 of the body 12. These pockets 22, 24 may be engaged by forks (not shown) of a lifting mechanism (not shown) of a trash collection truck (not shown) in order to lift the trash bin 10 and dump its contents into a suitable receptacle (not shown) in the trash collection truck.

Figure 2:
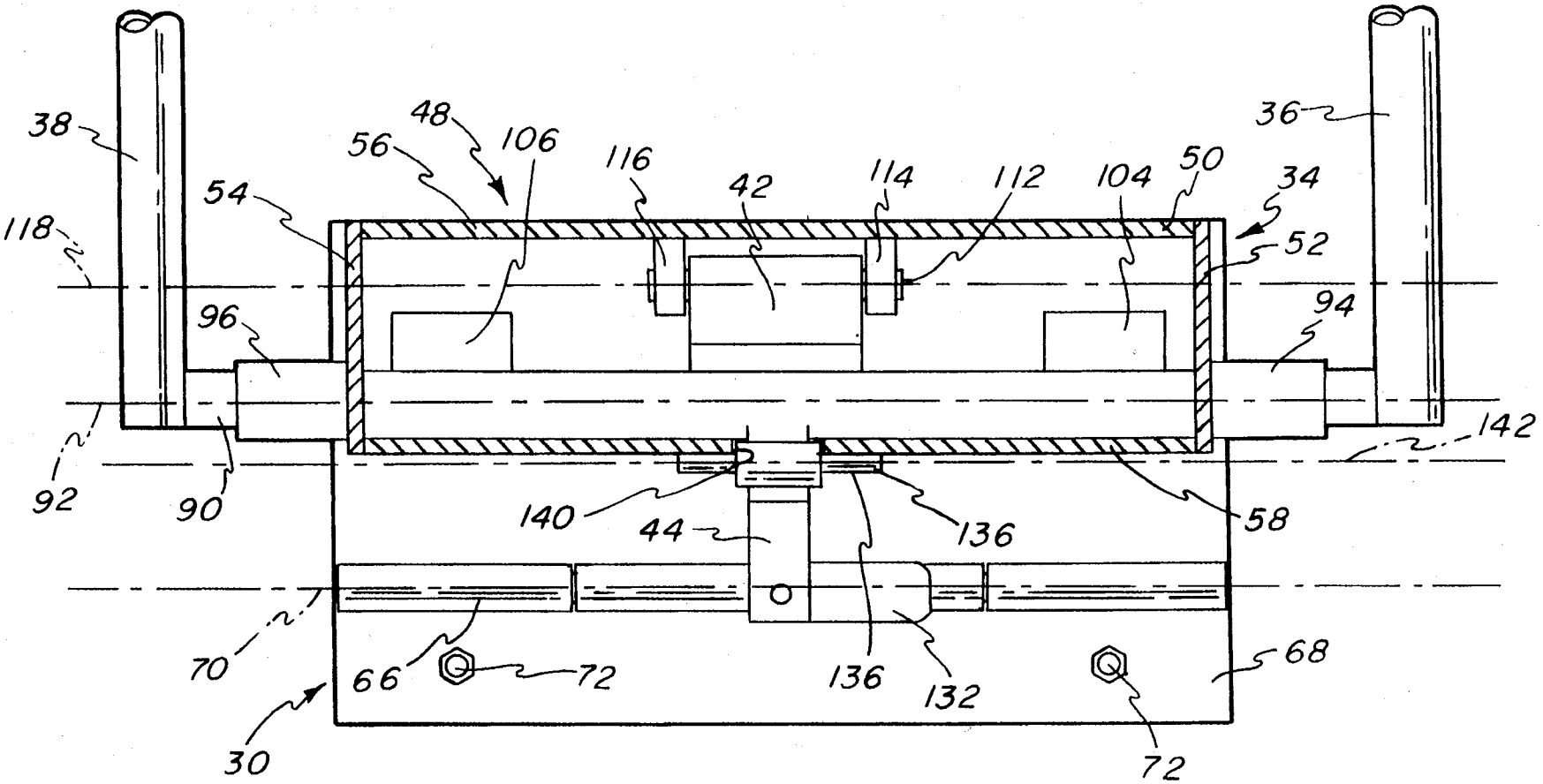
FIG. 2 is a front elevational view of the locking mechanism of FIG. 1 with the front portion of the lower bracket and the depending lug of the frame removed.
Figure 3:
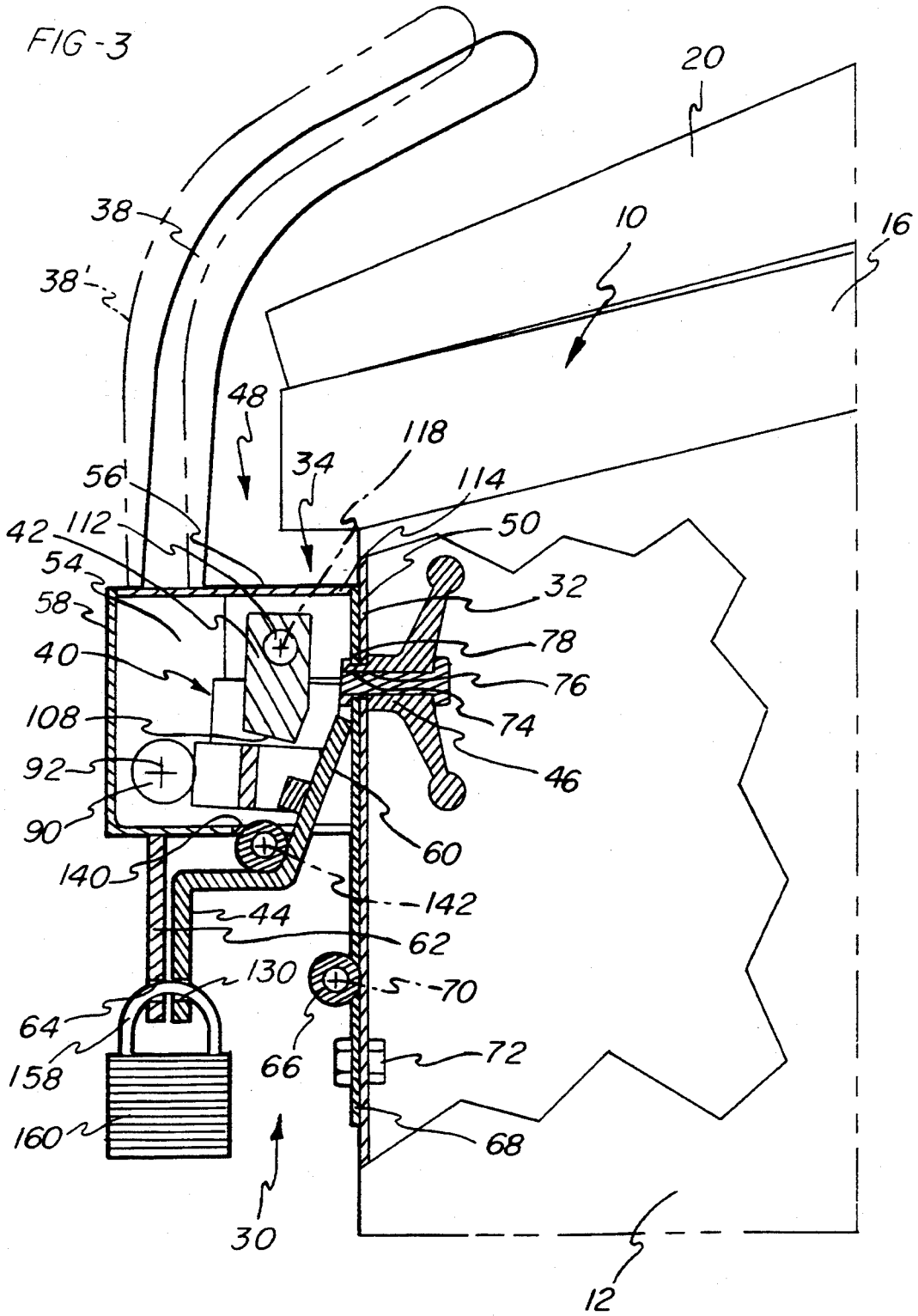
FIG. 3 is a side sectional view of the trash bin and locking mechanism taken along the line 3—3 in FIG. 1.

A locking mechanism 30 is mounted on a front wall 32 of the trash bin 10 to secure the lids 18, 20 of the trash bin 10 in a closed position against the flange 16. Referring to FIGS. 1–3, the locking mechanism 30 comprises a support frame 34 and a mechanism including a pair of locking members 36, 38, an abutment member 40, a pawl 42 and a lever 44, each pivotally supported by the frame 34. In addition, the locking mechanism 30 includes a coupler 46 adapted to extend through the front wall 32 of the trash bin 10 for engagement with the support frame 34 of the locking mechanism 30.

The support frame 34 includes a first portion 48 having rear plate 50; a pair of side plates 52, 54 rigidly connected to the rear plate 50; an upper plate 56 rigidly connected to the rear plate 50 and the sides plates 52, 54; and a lower bracket 58 rigidly connected to the side plates 52, 54. The first portion 48 defines a housing which encloses the abutment member 40, the pawl 42 and a portion 60 (FIG. 3) of the lever 44. The first portion 48 also includes a depending lug 62 (FIG. 3) aligned with the lever 44 and having an eye 64 (FIG. 3).

The first portion 48 of the support frame 34 is pivotally supported by a pivotal coupler or hinge 66 fixed to a plate 68 defining a second portion of the frame for pivotal movement about an axis 70 parallel to the front wall 32 of the trash bin 10. The plate or second portion 68 is coupled to the front wall 32 by means of a pair of bolts 72. The rear plate 50 also includes a hole 74 aligned with a hole 76 in the front wall 32 through which the coupler 46 extends to engage a nut 78 welded to the rear plate 50. When engaged with the nut 78, the coupler 46 restrains the first portion 48 from pivotal movement relative to the front wall 32.

Figure 4:
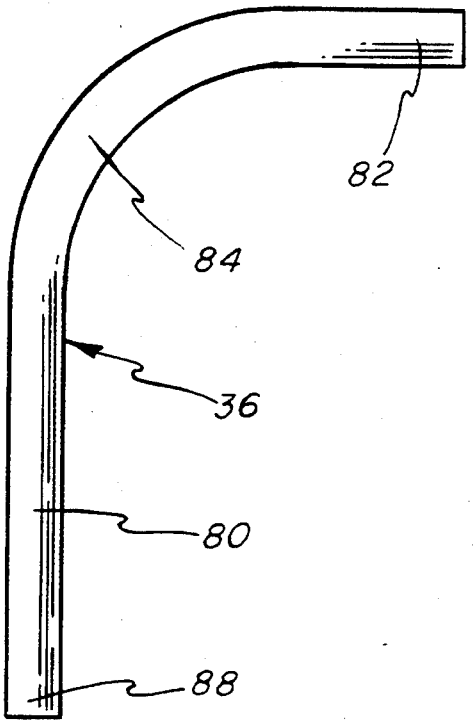
FIGS. 4 and 5 are front and side elevational views, respectively, of a locking member for use in the locking mechanism of FIGS. 1, 2 and 3.
Figure 5:
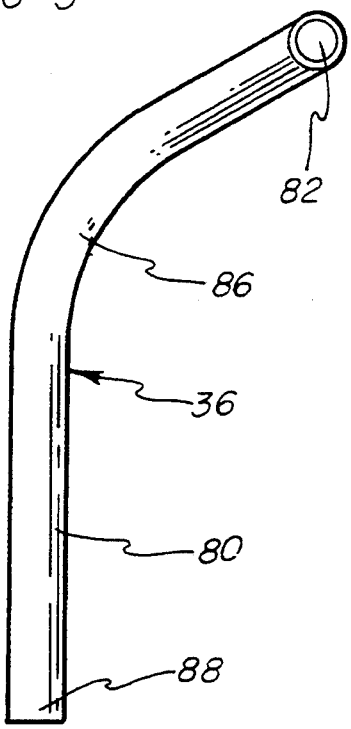

The locking members 36, 38, comprise bent metal tubular rods. Since, as best seen in FIG. 1, the locking members 36, 38 are fabricated as mirror images of one another, only locking member 36 (shown in FIGS. 4 and 5) will be described in detail. The locking member 36 includes a straight portion 80 and a lid-restraining portion 82 which extends perpendicularly to the straight portion 80. The lid-restraining portion 82 is defined by two coincident elbows, a right angle elbow 84 in the plane of the front wall 32 of the trash bin 10 and a 150° elbow 86 in a plane normal to the front wall. The end portion 88 of the straight portion 80 is coupled in a conventional manner to an end of a shaft 90 which is journaled in holes (not shown) in the side plate 52, 54 of the support frame 34 for pivotal movement about an axis 92 parallel to the plane of the front wall 32 of the trash bin 10. As best shown in FIGS. 1 and 2, sleeves 94, 96 are fixed to the side walls 52, 54 of the support frame 34 in alignment with the holes (not shown) through the side plates 52, 54 to provide further support for the shaft 90.

Figure 12:
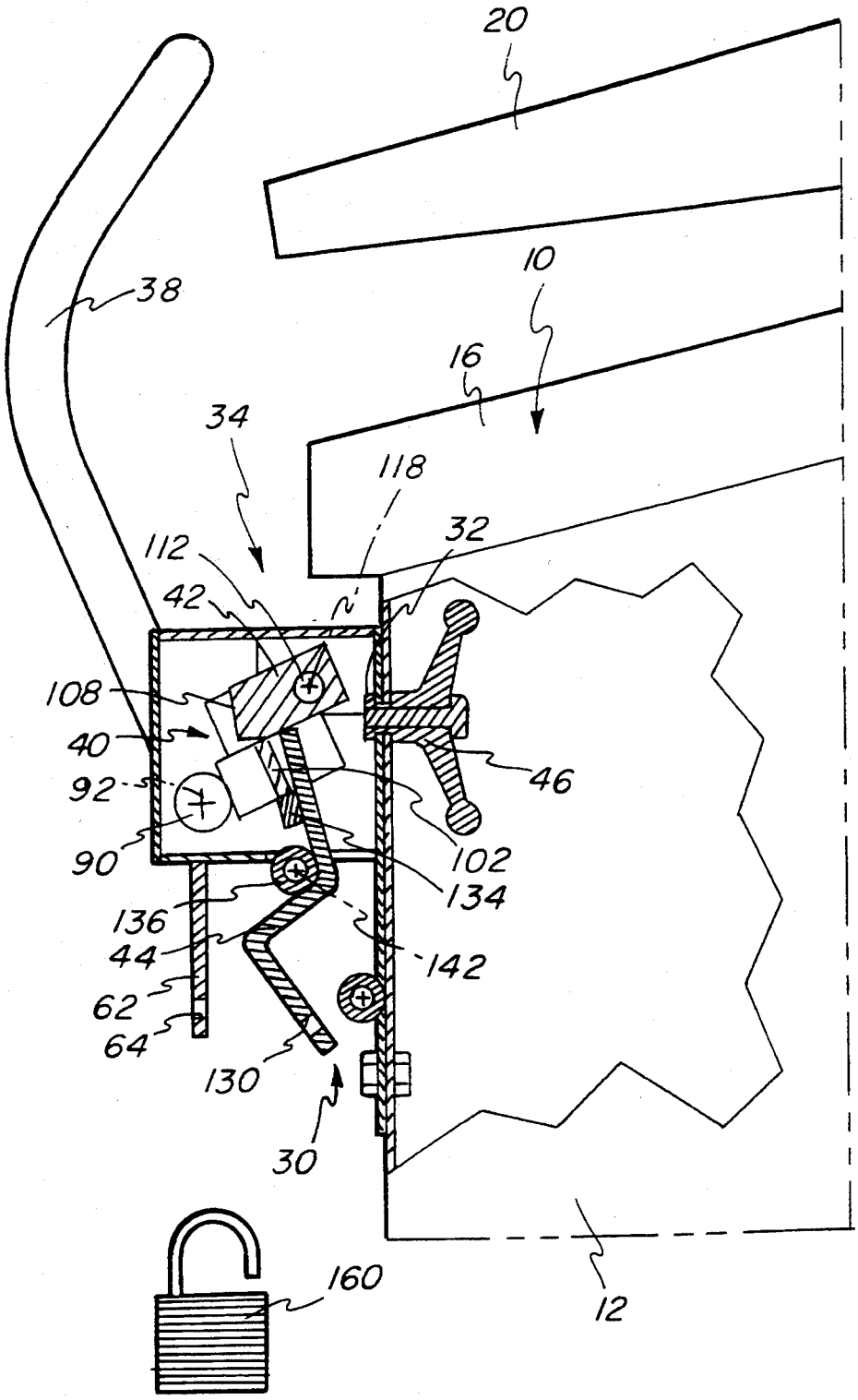
FIG. 12 is a side sectional view of the locking mechanism of FIGS. 1, 2 and 3 shown released by means of pivotal movement of the lever of FIGS. 8 and 9.

As best shown in FIGS. 2 and 12, the locking members 36, 38 are cantilevered on tile shaft 90 to permit pivotal movement of the locking members 36, 38 about the axis 92 between a locked position (FIG. 2) and a released position (FIG. 12). In the locked position, the lid-restraining portions 82 overlie the lids 18, 20 to prevent the lids from pivoting out of their closed position. In the released position, the lid-restraining portions 82 are pivoted away from the lids 18, 20, thereby permitting the lids 18, 20 to pivot out of the closed position to permit trash to be deposited in the interior of the trash bin 10.

Figure 6:
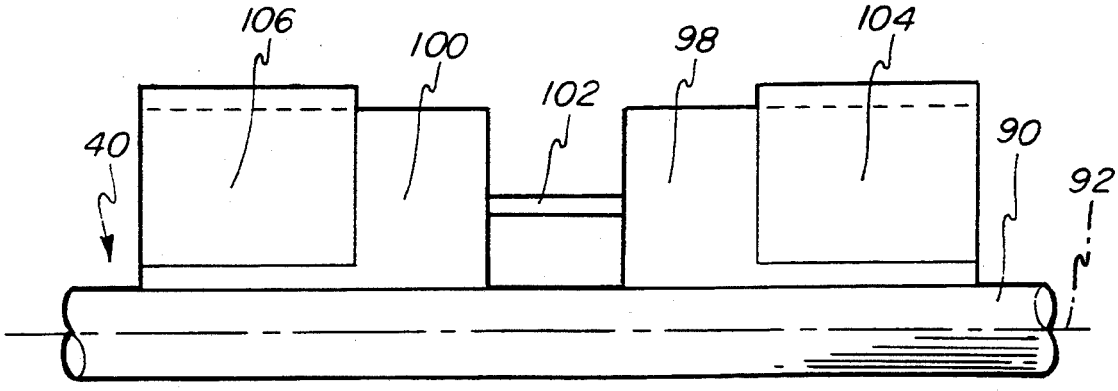
FIG. 6 is a plan view of an abutment member for use in the locking mechanism of FIGS. 1, 2 and 3.

As best shown in FIGS. 3 and 6, the abutment member 40 is coupled to the shaft 90 in a conventional manner, as by welding. The abutment member 40 comprises a pair of cantilevered abutment blocks 98, 100 joined by a web 102 which is welded to the two abutment blocks 98, 100. The two abutment blocks 98, 100 each carry a block 104, 106. The abutment member 40 is coupled to the shaft 90 such that restraining the pivotal movement of the abutment member 40 likewise restrains the pivotal movement of the locking members 36, 38 between their locked and released positions.

Figure 7:
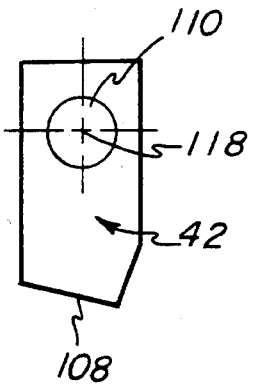
FIG. 7 is a side elevational view of a pawl for use in the locking mechanism of FIGS. 1, 2 and 3.

As best shown in FIG. 7, the pawl 42 comprises a block of metal having a pentagonal cross-section defining an abutment surface 108. The pawl 42 additionally comprises a through hole 110. As best shown in FIGS. 2 and 12, the pawl 42 is pivotally supported by the support frame 34 through the agency of a shaft 112 which passes through the hole 110. The shaft 112 is supported near its ends by a pair of support blocks 114, 116 which are each welded to the rear plate 50 and the upper plate 56 of the support frame 34.

The pawl 42 is pivotal about a pawl axis 118 between a normal position (FIG. 2) and a parallel position (FIG. 12). As best shown in FIG. 2, the abutment surface 108 of the pawl 42 faces the abutment blocks 98,100 of the abutment member 40 when the pawl 42 is in its normal position and the locking members 36, 38 are in their locked positions so as to restrain the locking members 36, 38 from pivotal movement toward their released position.

Figure 8:
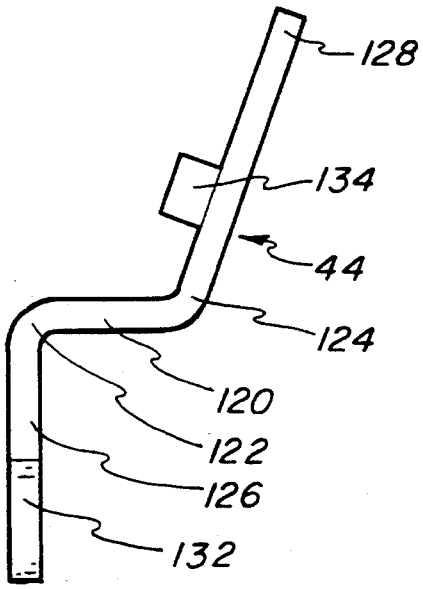
FIGS. 8 and 9 are front and side elevational views, respectively, of a lever for use in the locking mechanism of FIGS. 1, 2 and 3.
Figure 9:
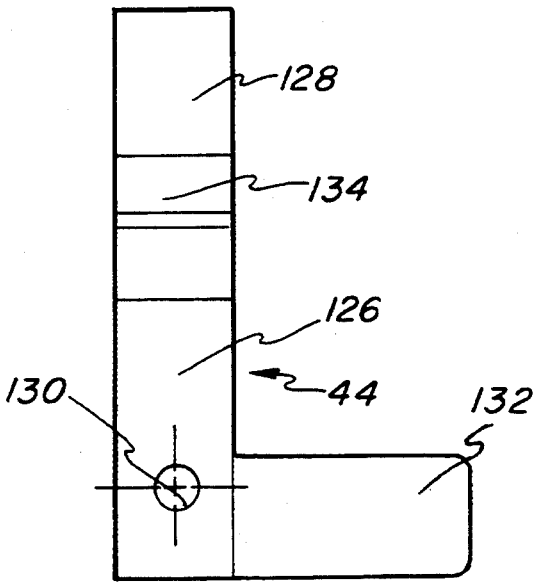

As best shown in FIGS. 8 and 9, the lever 44 comprises a strip of metal 120 having a right angle elbow 122 and a 110° elbow 124 defining a handle portion 126 and pawl-striking portion 128, respectively. The handle portion 126 of the lever 44 includes a second eye 130 which aligns with the first eye 64 in the lug 62 to permit the handle portion 126 of the lever 44 to be shackled to the lug 62. The handle portion 126 also mounts a handle 132 which is welded to a side of the handle portion 126. The pawl-striking portion of the lever 44 mounts a stop 134 which is likewise welded to the surface of the pawl-striking portion 128 of the lever 44.

As shown in FIG. 3, the lever 44 is pivotally supported by the housing 34 through the agency of a shaft 136 which passes through a sleeve 138 welded to an interior of the 110° elbow 124. The shaft 136 is supported at opposite ends to the lower bracket 58 of the support frame 34. An aperture 140 is provided in the lower bracket 58 to permit the lever to pivot between a first position (FIG. 2) and second position (FIG. 12).

Figure 10:
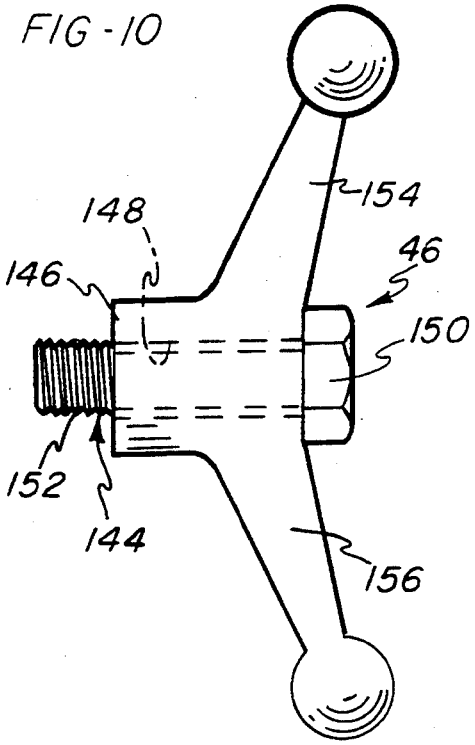
FIG. 10 is a side elevational view of a coupler for use in the locking mechanism of the FIGS. 1, 2 and 3.

As best seen in FIG. 10, the coupler 46 comprises a handle and screw mechanism including a threaded fastener 144 and a speedball handle 146. The speedball handle 146 has a threaded bore 148 for receiving the threaded fastener 144 up to a head 150, thereby exposing a threaded end portion 152 of the threaded fastener 144 for engagement with the nut 78 welded to the rear plate 50 of the support frame 34. As shown in FIG. 3, the coupler 46 preferably engages the first portion 48 of the support frame 34 vertically above the axis 70 of the hinge 66.

The speedball handle 146 also includes a pair of wings 154, 156 for grasping the speedball handle 146 to turn the threaded fastener 144. The use of a speedball handle as shown in FIG. 10 is preferred due to its ease of manipulation and its resistance to damage from trash thrown into the trash bin 10.

The operation and method for securing the lids 18, 20 of the trash bin 10 using the locking mechanism 30 will now be described in connection with FIGS. 3 and 11–13. (While the locking member 36, the lid-restraining portions 82 of the locking members 36, 38 and the lid 18 are not shown in FIGS. 3 and 11–13 due to the sections along which those Figures are cut, the functions of these parts will be described for completeness.) In FIGS. 1, 2 and 3, the locking mechanism 38 is shown securing the lids 18, 20 (FIGS. 1 and 2) against the flange 16 of the trash bin 10. The locking members 36, 38 (FIGS. 1 and 2) are in an upright locked position in which the lid-restraining portions 82 overhang the lids. 18, 20 to restrain the lids 18, 20 from pivoting out of a closed position. The pawl 42 is in its normal position so that the abutment surface 108 faces the abutment member 40 to limit pivotal movement of the locking members 36, 38 out of their locked position.

The lever 44 is in its first position out of engagement with the pawl 42. The exposed threaded end portion 150 of the threaded fastener 142 of the coupler 46 extends through the hole 76 in the front wall 32 of the trash bin 10 and the hole 74 in the rear plate 50 of the support frame 34 to engage the nut 78 to restrain the first portion 48 of the support frame 34 from pivotal movement relative to the front wall 32 about the axis 70 of the hinge 66.

As shown in FIG. 3, the lid-restraining portions 82 of the locking members 36, 38 do not actually contact the lids 18, 20 while they are lying in their closed position. Rather, the lid-restraining portions 82 overhang the lids 18, 20 and prevent the lids 18, 20 from being opened widely enough to deposit trash. It is within the scope of the invention, however, to provide structure (not shown) which rigidly contacts the lids 18, 20 when the locking members 36, 38 are in their locked position. Furthermore, the locking members 36, 38 are slightly pivotable, as to the position 38' shown in FIG. 3, even when the pawl 42 is in its normal position with respect to the abutment member 40. Movement of the locking members 38 to the position 38' would move the abutment member 40 into engagement with the abutment surface 108 in line with the shaft 112, so that the pawl 42 would obstruct the locking members 36, 38 from further pivotal movement away from their locking position.

A shackle 158 of a padlock 160 extends through the second eye 130 in the lever 44 and the first eye 64 in the lug 62 to couple the lug 62 and the handle portion 126 of the lever 44. The shackle 158 restrains the lever 44 from pivoting from its first position toward its second position. The padlock 160 may be a key-actuated lock or a combination look. Alternatively, a fastener (not shown) may be used as a shackle to couple the lug 62 and the lever 44.

Figure 11:
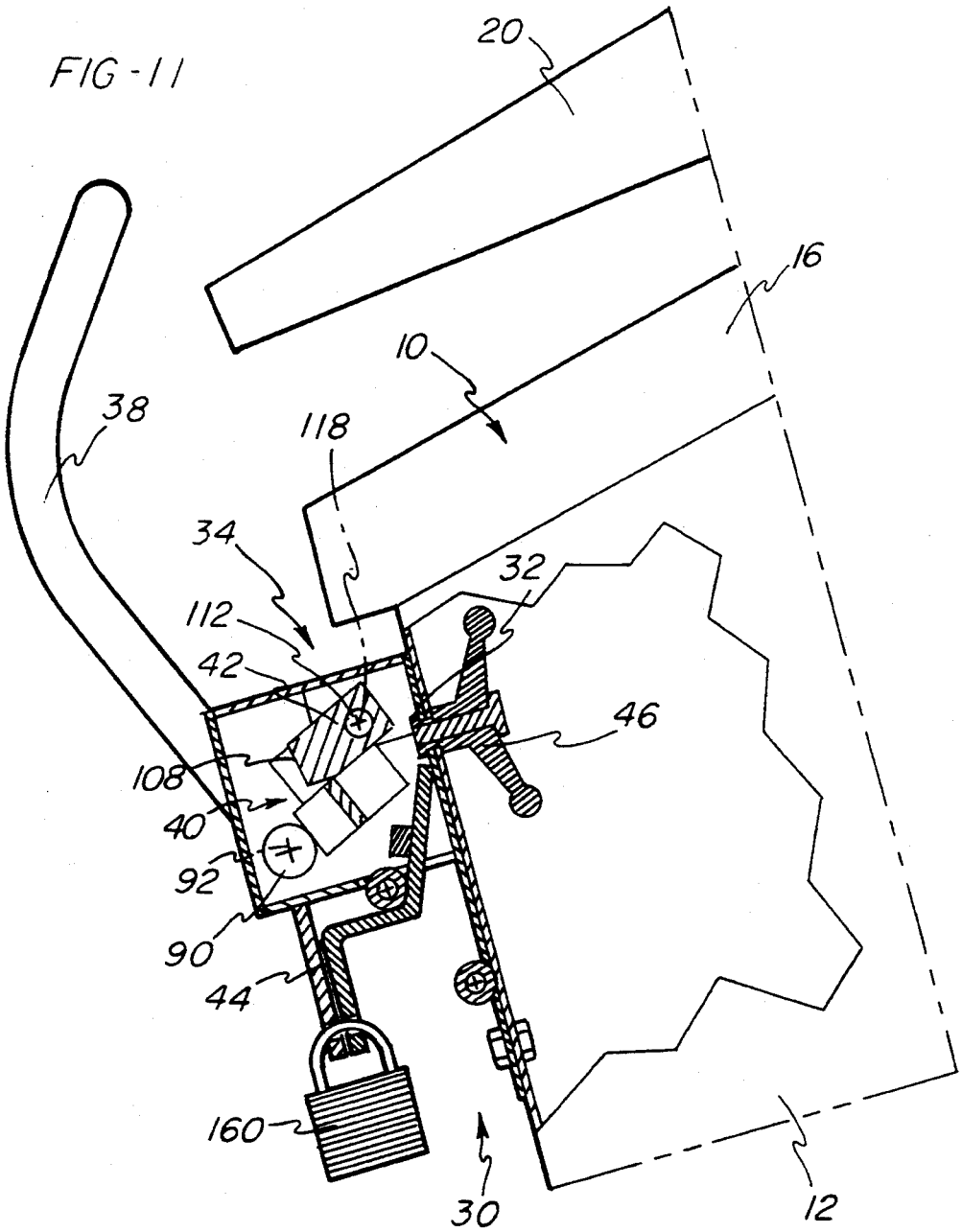
FIG. 11 is a side sectional view of the locking mechanism of FIGS. 1, 2 and 3 shown released during the dumping of the trash bin.

As best shown in FIG. 11, dumping of the trash bin 10, that is, pivoting of the trash bin about an-axis normal to its side walls 24, 26 (FIG. 1), leads to pivotal movement of the pawl 42 under the force of gravity about the pawl axis 118 to a parallel position in which the abutment surface 108 no longer faces the abutment member 40. Pivotal movement of the pawl 42 into its parallel position with respect to the abutment member 40 releases the locking members 36, 38 to pivot under their own weight toward their released position shown in FIG. 11. When the locking members 36, 38 are in this released position, the lid-restraining portions 82 cease to overhang the lids 18, 20, thereby permitting the lids 18, 20 to pivot out of their closed position so that trash (not shown) may fall under its own weight from the interior of the trash bin 10 into a suitable receptacle (not shown) on a trash collection truck (not shown). This process does not require unshackling of the lever 44 from the lug 62, since release of the locking member in this mode of operation does not require movement of the lever 44.

When the trash bin 10 is returned to the upright position shown in FIG. 3 after being dumped, the weight of the abutment member 40 returns the locking members 36, 38 to the locked position in which the lid-restraining portions 82 again overhang the lids 18, 20. The pawl 42 pivots under its own weight back into its normal position in which the abutment surface 108 faces the abutment member 40. In this condition, the locking members 36, 38 are once again restrained against pivotal movement out of their locked position and the lids 18, 20 of the trash bin 10 are once again restrained against pivotal movement out of their closed position.

As shown in FIG. 12, pivotal movement of the lever 44 from its first position to its second position against the pawl 42 moves the pawl 42 away from its normal position, thereby releasing the locking members 36, 38 to pivot toward their released position. When the locking members 36, 38 are in this released position, the lids 18, 20 are again free to pivot out of their closed position so that trash may be deposited in the interior of the trash bin 10. The web 102 of the abutment member 40 rests against the stop 134 of the lever 44 to hold the locking members 36, 38 in their released position.

When the lever 44 is once again pivoted to its first position, as by pulling the handle 132 toward the lug 62 of the support frame 34, the stop 134 of the lever 44 is dislodged from abutment with the web 102 of the abutment member 40. The weight of the abutment member 40 pivots the locking members 36, 38 back toward their locked position in which the lid-restraining portions 82 again secure the lids 18, 20 of the trash bin 10. The pawl 42 pivots under its own weight back towards its normal position in which the abutment surface 108 again faces the abutment member 40 to restrain the locking members 36, 38 from pivoting out of their locked position. Once the lever 44 is returned to its first position, it may be reshackled to the lug 62 as in FIG. 3 to prevent unauthorized individuals from opening the lids 18, 20 of the trash bin 10.

Figure 13:
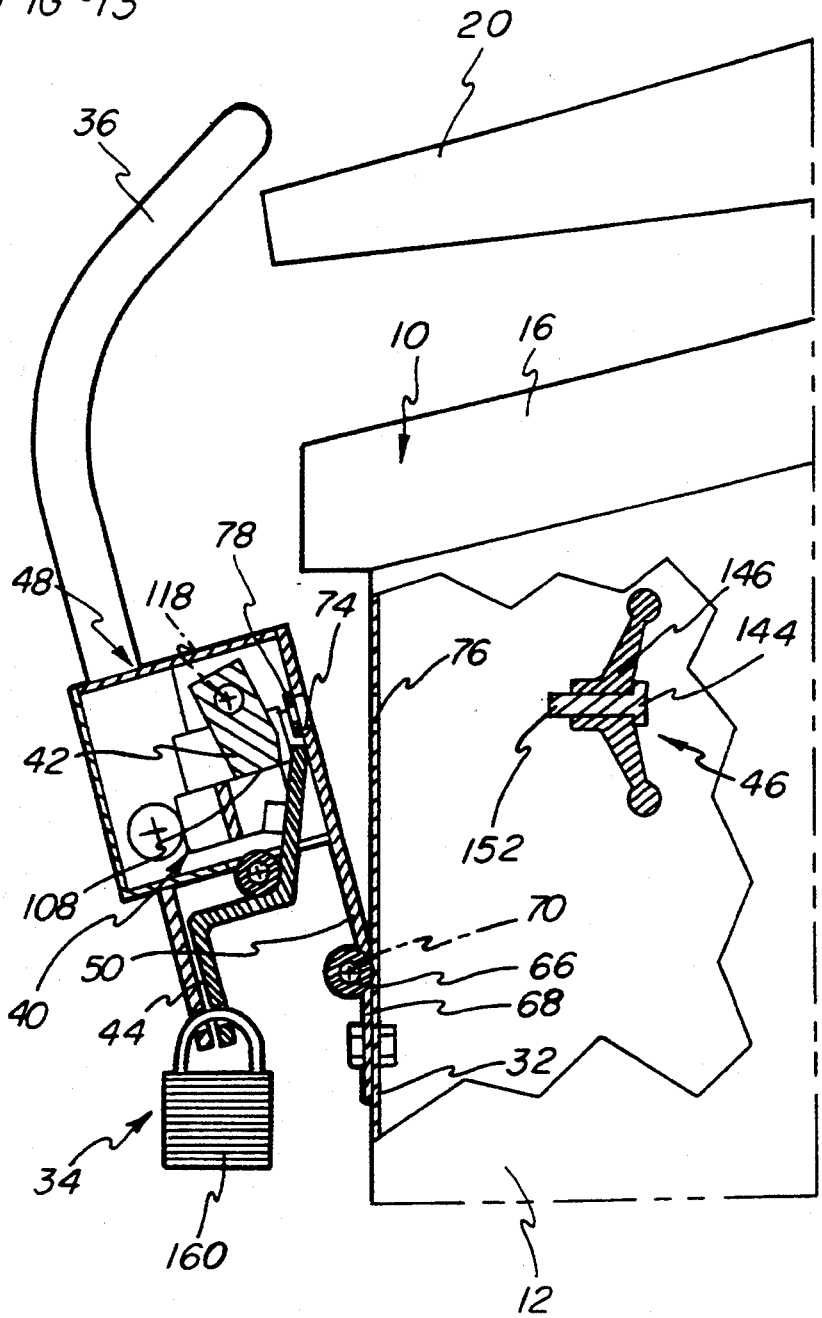
FIG. 13 is a side sectional view of the locking mechanism of FIGS. 1, 2 and 3 shown released after the coupler of FIG. 10 is detached from the support frame.

An individual locked inside the trash bin 10 may turn the speedball handle 146 to release the threaded fastener 144 from engagement with the nut 78 as shown in FIG. 13. When the threaded fastener 144 is released from engagement with the nut 78, the coupler 46 ceases to restrain the first portion 48 of the frame support 34 from pivotal movement about the axis 70 of the hinge 66. Since the center of gravity (not shown) of the first portion 48 of the frame 34 and of the parts supported by the first portion 48 lies vertically above the hinge 66 and horizontally outwardly from the front wall 32, the first portion 48 pivots away from the front wall 32 under its own weight.

Pivotal movement of the first portion 48 of the support frame 34 about the axis 70 of the hinge 66 leads to movement of the lid-restraining portions 82 of the locking members 36, 38 away from the lids 18, 20 of the trash bin 10. As the lid-restraining portions 82 cease to overhang the lids 18, 20, the lids 18, 20 are freed to pivot out of their closed positions. The individual inside the trash bin 10 may now lift, one or both of the lids 18, 20 and exit the trash bin 10 without requiring assistance from outside.

If it is desired to again secure the lids 18, 20, the locking members 36, 38, if not already released by the pivotal movement of the first portion 48 of the support frame 34, may be pivoted to their released positions by means of pivotal movement of the level 44 from its first position toward its second position. The first portion 48 of the support frame 34 may then be pivoted about the axis 70 of the hinge 66 until the rear plate 50 again lies against the front wall 32 of the trash bin 10. The exposed threaded end portion 152 of the threaded fastener 144 may be extended through the holes 74, 76 into engagement with the nut 78 to again restrain pivotal movement of the first portion 48 about the hinge axis 70. The locking members 36, 38 may then be pivoted back toward their locked position in which the lid-restraining portions 82 overhang the lids 18, 20. Once the locking members 36, 38 are returned to their locked position, the pawl 44 pivots under its own weight to its normal position in which the abutment surface 108 faces the abutment member 40.

The coupler 46 preferably comprises a speedball handle 146 because the speedball handle 146 is relatively easy to manipulate and is fairly strong to resist damage from trash entering into the trash bin 10. While the coupler 46 has been described as comprising a threaded fastener 144 and a speedball handle 146, it may instead comprise any conventional coupling or fastener capable of detachably coupling the rear plate 50 of the support frame 34 to the front wall 32 of the trash bin 10 so that the rear plate 50 may be manually decoupled from the front wall 32 from the interior of the trash bin 10. For example, a threaded fastener (not shown) may be permanently affixed as by welding to the rear plate 50 so that the threaded fastener (not shown) extends through the hole 76 for engagement with a nut or speedball handle (not shown). In this embodiment, an individual locked inside the trash bin 10 may remove the nut or speedball handle (not shown) from the threaded fastener (not shown) to release the locking mechanism 30.

It should be noted that by locating the components of the locking mechanism 30 within the first portion or housing 48 formed by the frame 34, the components of the locking mechanism 30 are substantially isolated from the deleterious effects of the weather and substances within the bin. Furthermore, the housing 48 for the components of the locking mechanism 30 permits the locking mechanism as a whole to break away from the bin, as the housing 48 pivots during the during the release operation illustrated in FIG. 13 to thereby ensure that the components of the locking mechanism 30 remain isolated in the first portion 48 for all modes in which the locking members 36, 38 are released from their locking positions. Since the locking mechanism 30 and the trash bin 10 are constructed as separate units, the locking mechanism 30 can be retrofit onto existing bins.

Various changes or modifications in the invention described may occur to those skilled in the art without departing from the true spirit or scope of the invention. The above description of the invention is intended to be illustrative only and not limiting and it is not intended that the invention be restricted thereto but that it be limited only by the true spirit and scope of the appended claims.

What is claimed is:

1. Apparatus for securing a lid of a trash bin, said apparatus comprising:

a frame couplable to a wall of the trash bin;

at least one locking member supported by said frame for movement between a locked position and a released position, said at least one locking member including a lid-restraining portion for restraining the lid of the trash bin from movement out of a closed position when said at least one locking member is in its locked position;

an abutment member operatively associated with said at least one locking member to restrain said at least one locking member from movement from the locked position toward the released position;

a pawl supported by said frame for movement toward and away from a normal position in which said pawl intersects a path of movement of said abutment member; and a lever supported by said frame for movement between a first position and a second position;

wherein movement of said lever from the first position toward the second position moves said pawl away from its normal position to release said at least one locking member from restraint against movement toward its released position.

2. The apparatus as recited in claim 1 wherein said pawl is pivotally supported by said frame for movement about a pawl axis by means of gravity and in response to pivotal movement of said frame about an axis parallel to the pawl axis.

3. The apparatus as recited in claim 1 wherein said lever is pivotally supported by said frame for movement between its first and second positions.

4. The apparatus as recited in claim 3 including a stop movable with said lever for engaging said abutment member to restrain said at least one locking member in its released position when said lever is in its second position.

5. The apparatus as recited in claim 1 wherein said lever includes an eye for receipt of a shackle to couple said lever to said frame for restraining movement of said lever from its first position toward its second position.

6. The apparatus as recited in claim 1 including at least two locking members wherein said abutment member extends between said at least two locking members.

7. The apparatus as recited in claim 1 wherein said frame defines a housing which at least partially encloses said abutment member, said pawl and said lever.

8. The apparatus as recited in claim 1 wherein said frame includes a first portion and a second portion pivotally coupled to said first portion, such that said at least one locking member is supported for pivotal movement by said first portion and said second portion is adapted to be rigidly mounted to a wall of the trash bin.

9. Apparatus for securing a lid of a trash bin, said apparatus comprising:

a frame couplable to a wall of the trash bin;

at least one locking member supported by said frame for movement between a locked position and a released position, said at least one locking member including a lid-restraining portion for restraining the lid of the trash bin from movement out of a closed position when said at least one locking member is in its locked position;

an abutment member operatively associated with said at least one locking member to restrain said at least one locking member from movement from the locked position toward the released position;

a pawl having an abutment surface, said pawl being supported by said frame for movement toward and away from a normal position in which said abutment surface faces said abutment member to obstruct pivotal movement of said abutment member;

a lever supported by said frame for movement between a first position and a second position;

wherein movement of said lever from the first position toward the second position moves said pawl away from its normal position to release said at least one locking member from restraint against movement toward its released position;

said frame including a first portion and a second portion pivotally coupled to said first portion, such that said at least one locking member is supported for pivotal movement by said first portion and said second portion is adapted to be rigidly mounted to a wall of the trash bin; and a coupler for detachably coupling said first portion to the wall of the trash bin.

10. The apparatus as recited in claim 9 wherein said coupler includes a handle and screw mechanism threadly engaged with said first portion.

11. An apparatus for securing a lid of a trash bin, said apparatus comprising:

a frame including a first portion, a second portion and a pivotal connector coupling said first and second portions, said second portion being couplable to a wall of the trash bin;

at least one locking member supported by said first portion of said frame for movement with said first portion toward and away from a locked position, said at least one locking member including a lid-restraining portion for restraining movement of the lid of the trash bin out of a closed position when said at least one locking member is in its locked position; and a coupler adapted to extend through the wall of the trash bin to detachably couple said first portion of said frame to the wall, said coupler being detachable from said first portion of said frame to permit said at least one locking member to move away from said locked position to release the lid of the trash bin from restraint in its closed position.

12. The apparatus as recited in claim 11 including means defining a locking mechanism for releasably restraining said at least one locking member against movement out of said locked position, said frame defining a housing at least partially enclosing said means.

13. The apparatus as recited in claim 11 wherein said at least one locking member is mounted for movement relative to said first portion of said frame away from said locked position.

14. The apparatus as recited in claim 11 in combination with a trash bin, wherein said frame and said wall of said trash bin each includes an aligned aperture for receiving said coupler.

15. The apparatus as recited in claim 14 wherein said coupler comprises a threaded fastener and a handle manually engagable in an interior of said trash bin to decouple said threaded fastener from said frame.

16. The apparatus as recited in claim 11 wherein said coupler is coupled to said frame vertically above said pivotal connector.

17. The apparatus as recited in claim 8 including a hinge such that said second portion is pivotally coupled to said first portion by said hinge.

18. The apparatus as recited in claim 9 including a hinge such that said second portion is pivotally coupled to said first portion by said hinge.

* * * * *